US005106014A

United States Patent [19]

Miller

[11] Patent Number: 5,106,014

[45] Date of Patent: Apr. 21, 1992

[54] CARTON CARRYING HANDLE

[75] Inventor: Charles A. Miller, Williamsburg, Ohio

[73] Assignee: The C. W. Zumbiel Co., Cincinnati, Ohio

[21] Appl. No.: 581,461

[22] Filed: Sep. 12, 1990

[51] Int. Cl.[5] ..... B65D 25/30

[52] U.S. Cl. ..... 229/117.13; 229/117.12

[58] Field of Search ..... 229/117.09, 117.12, 229/117.13

[56] References Cited

U.S. PATENT DOCUMENTS

| | | | |
|---|---|---|---|
| 4,706,876 | 11/1987 | Wilson | 229/117.13 |
| 4,784,316 | 11/1988 | Crouch | 229/117.13 |
| 4,785,991 | 11/1988 | Schuster | 229/117.13 |
| 4,811,894 | 3/1989 | Schuster | 229/117.13 |

FOREIGN PATENT DOCUMENTS

| | | | |
|---|---|---|---|
| 1602857 | 11/1981 | United Kingdom | 229/117.12 |

*Primary Examiner*—Stephen Marcus
*Assistant Examiner*—Christopher McDonald
*Attorney, Agent, or Firm*—Wood, Herron & Evans

[57] ABSTRACT

A carton carrying handle particularly adapted for use with a wraparound type carton in which cans, e.g., soft drink or beer cans, are sold. The handle includes a handle flap defined in the carton's top panel by a free edge cut line disposed substantially transversed to the panel's longitudinal axis, and by a generally curved hinge line located opposite to and spaced from the free edge cut line with that curved hinged line being bowed toward the free edge cut line. An extender cut line is connected to each end of the curved hinge line so as to constitute co-linear extensions of the hinge line, each of those extender cut lines being of a length that traverses an adjacent fold line which connects the top wall panel and an adjacent side wall panel so that each extender cut line terminates within a side wall panel. Each end of the free edge cut line is connected with an adjacent extender cut line so as to fully define the handle flap. Accordingly, the handle flap is foldable on the curved hinge line beneath the top wall panel to form a handle hole that permits a user's fingers to be received therethrough when the carton is being carried by the user.

16 Claims, 2 Drawing Sheets

CARTON CARRYING HANDLE

This invention relates to cartons. More particularly, this invention relates to a carrying handle for a carton.

In the marketing of soft drinks and beer, it is well known to sell those retail consumer products in cans which are grouped together in six packs or twelve packs. Particularly in the case of twelve can packs, it is common to package the cans in cartons so as to make it easier to handle the product for the wholesaler and the retailer, as well as for the retail consumer.

There are any number of different types of can cartons known to the prior art. But one particular type that has found significant commercial success over the years is a so-called wraparound carton. In a wraparound carton, a number of cans, e.g., twelve, are wrapped in a paperboard box or carton comprised of top and bottom wall panels, side wall panels, and end flaps on each end. The end flaps at each end are sealed one to the other, thereby providing a closed or sealed package or carton for the cans.

Now with the wraparound can carton package so formed, it is desirable to provide a carrying handle so the retail consumer can more easily carry the carton. There are any number of different carrying handles known to the wraparound carton art. But the overall purpose of such carton handles is to provide an easy to use handle that is structurally sound so the consumer can pick up and carry the wraparound carton simply through use of the handle structure.

Accordingly, it has been the objective of this invention to provide a novel carrying handle for a carton and, particularly, for a wraparound type carton, where the handle's structural components are formed directly from the top panel of the carton. And with this type handle, it is the particular objective of this invention to provide an improved carrying handle structure which maintains the structural integrity of the wraparound carton through the distribution chain until it is chosen by a retail consumer, which is very easy to render usable, and to use, by the retail consumer once the carton has been so chosen, and which does not adversely impact on the structural integrity of the carton when the handle is punched out of the carton's top panel by the user.

In accord with these objectives, this invention is directed to a carton carrying handle particularly adapted for use with a wraparound type carton in which cans, e.g., soft drink or beer cans, are sold. The handle includes a handle flap defined in the carton's top panel by a free edge cut line disposed substantially transversed to the panel's longitudinal axis, and by a generally curved hinge line located opposite to and spaced from the free edge cut line with that curved hinge line being bowed toward the free edge cut line. An extender cut line is connected to each end of the curved hinge line so as to constitute co-linear extensions of the hinge line, each of those extender cut lines being of a length that traverses an adjacent fold line which connects the top wall panel and an adjacent side wall panel so that each extender cut line terminates within a side wall panel. Each end of the free edge cut line is connected with an adjacent extender cut line so as to fully define the handle flap. Accordingly, the handle flap is foldable on the curved hinge line beneath the top wall panel to form a handle hole that permits a user's fingers to be received therethrough when the carton is being carried by the user.

Other objectives and advantages of the invention will be more apparent from the following detailed description taken in conjunction with the drawings in which.

Figure 3:
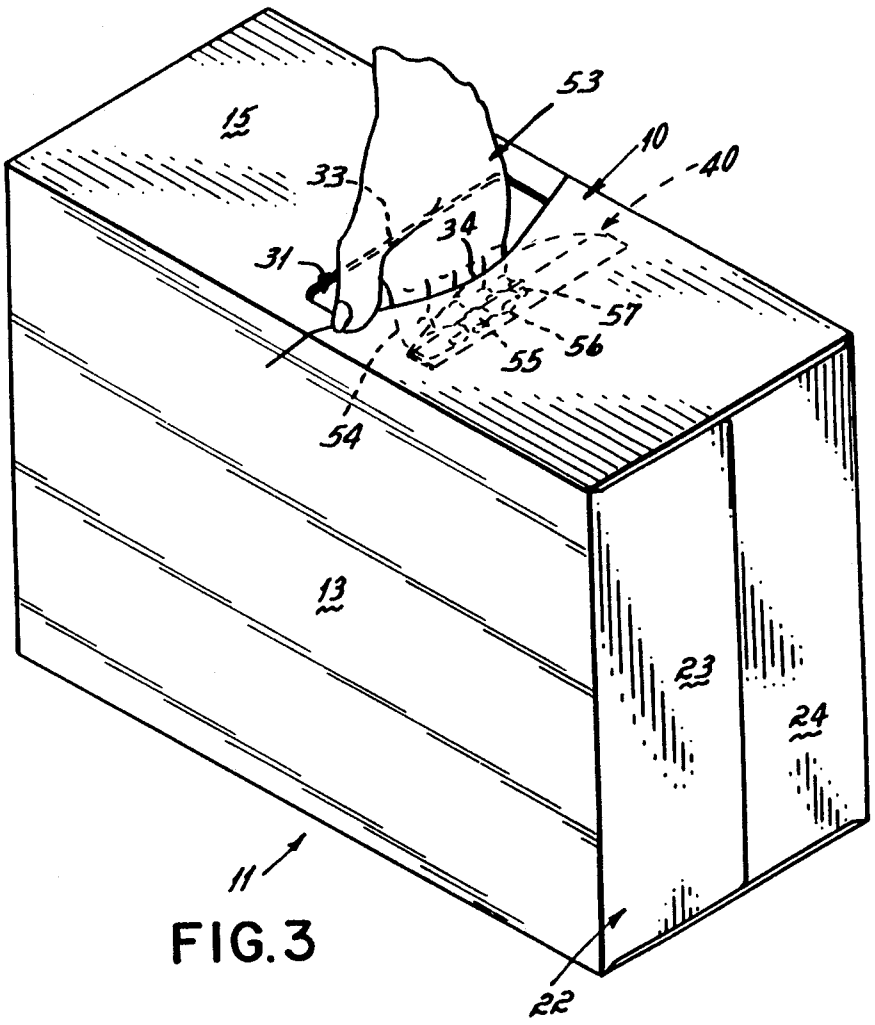
FIG. 3 is a perspective view similar to FIG. 1 but illustrating the handle in use configuration as opened by a user.
Figure 1:
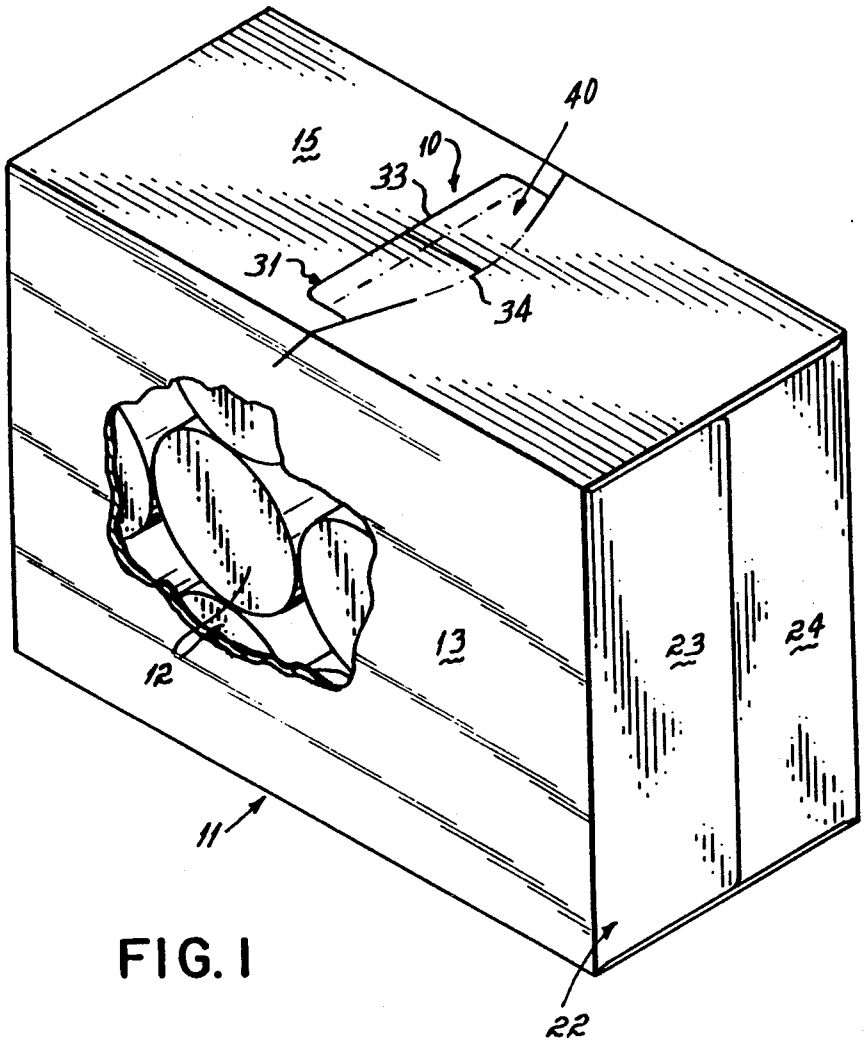
FIG. 1 is a perspective view of a wraparound type carton having a carrying handle in accord with the principles of this invention, the handle being shown in unused configuration.

The carrying handle 10 of this invention is adapted for use with a wraparound carton 11 as particularly shown in FIGS. 1 and 3. The wraparound carton 11 may be filled with, for example, cans 12 of soft drink or beer.

The wraparound carton 11 basically includes opposed side wall panels 13, 14, a top wall panel 15, and a bottom wall panel **16*a*, 16*b*, these panels all being foldably connected along side fold lines 17–20. Also, the carton 11 includes, on each end 21, 22, a pair of overlapping end panels 23, 24 that hinge on end fold lines 25, 26 of respective side wall panels 13, 14. Each end panel 23, 24 pair cooperates with top 27 and bottom 28*a*, 28*b*, dust panels that are hingedly connected to end fold lines 29 and 30*a*, 30*b* of the top 15 and bottom 16*a*, 16*b* wall panels. The end panels 23, 24 at each end 21, 22 of the wraparound carton 11 are glued or otherwise fastened together so that, in effect, the wraparound carton provides a single enclosed package for the cans 12** therewithin.

Figure 2:
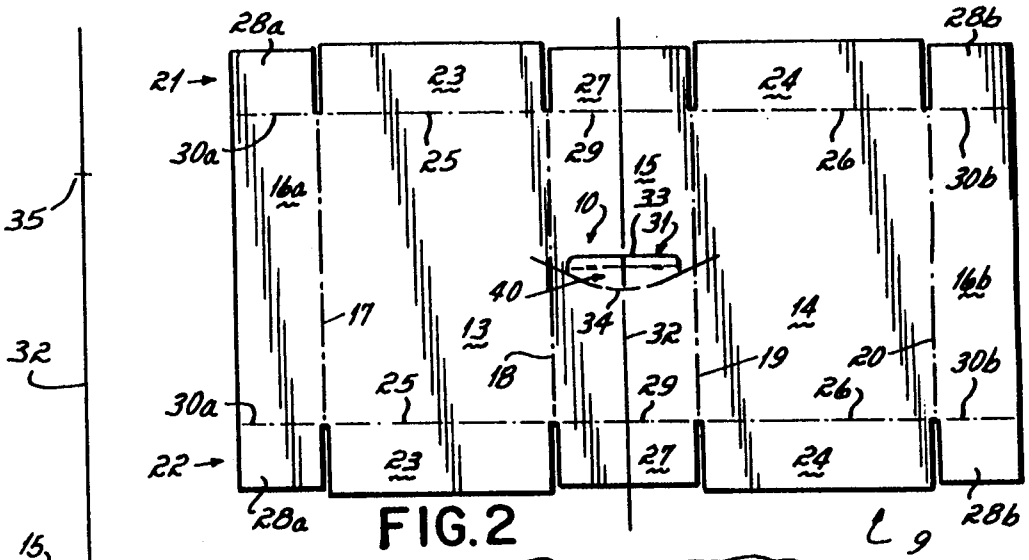
FIG. 2 is a view of the carton being shown in blank form, i.e., prior to folding into an erected carton.
Figure 2A:
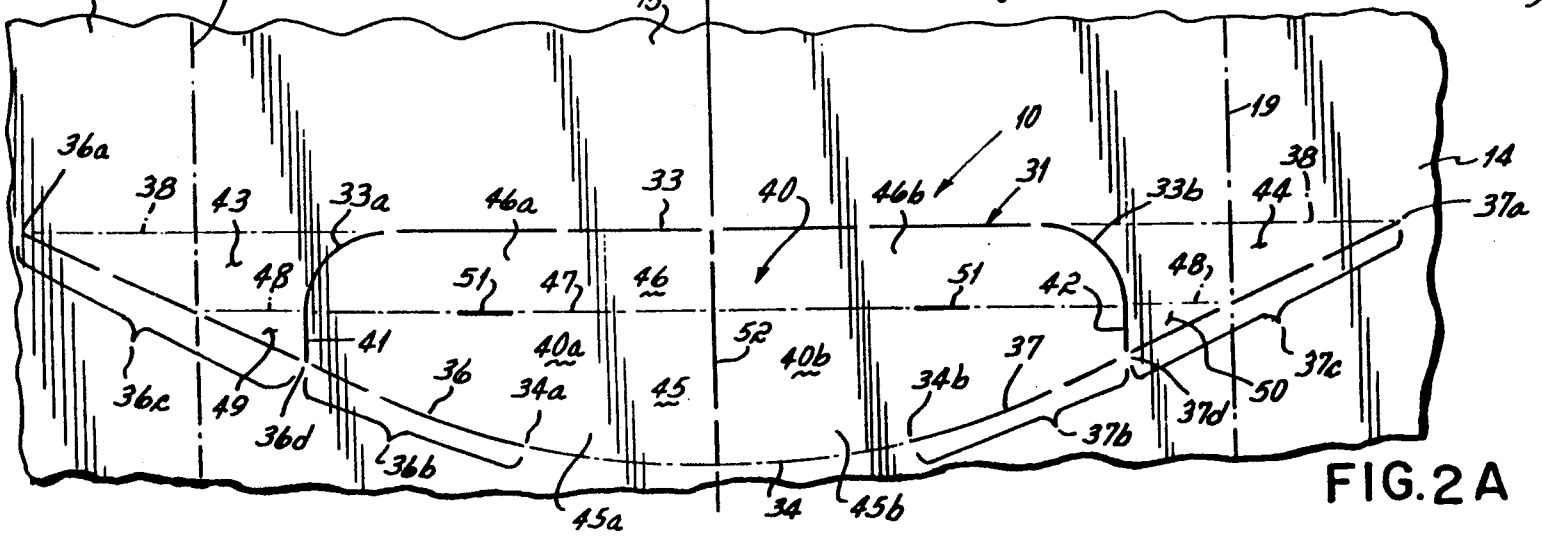
FIG. 2A is an enlarged top view of a section of the carton's top and side panels in the carrying handle area.

The carrying handle 10 of this invention, with the carton in blank 9 or non-erected configuration, is illustrated in detail in FIGS. 2 and 2A. As there shown, the blank includes the top wall panel 15 and two side wall panels 13, 14 hinged thereto on parallel fold lines 17, 18. A single elongated handle hole 31 is defined in the top panel 15, that handle hole being oriented generally normal to the longitudinal axis 32 of the top panel. The handle hole 31 is defined by a free edge breakaway cut line 33 located wholly within the top wall panel 15 and disposed substantially transverse to that panel's longitudinal axis 32. The opposed ends **33*a*, 33*b* of the free edge cut line 33 are located on opposite sides of that longitudinal axis 32. The handle hole 31 is also defined by a generally curved hinge line 34 located wholly within the top wall panel 15. The generally curved hinge line 34 is positioned opposite to and is spaced from the free edge cut line 33. Note the generally curved hinge line 34 is bowed toward the free edge cut line 33, and the opposite ends 34*a*, 34*b* of the curved hinge line are located on opposite sides of the longitudinal axis 32. In this regard, it is preferred that the generally curved hinge line 34 be of a generally arcuate configuration, and that the arc which defines that hinge line have a single radial center point 35 which is located on the longitudinal axis 32 on the opposite side of the free edge cut line 33** from the curved hinge line.

The elongated handle hole 31 is also partially defined by an extender cut line 36, 37 connected to each end **34*a*, 34*b*, respectively, of the curved hinge line 34. Note each extender cut line 36, 37 constitutes a co-linear extension of the hinge line 34. Note also each extender cut line 36, 37 is of a length that traverses an adjacent fold line 18, 19, respectively, that connects the top wall panel 15 and an adjacent side wall panel 13, 14, respectively, so that each extender cut line terminates at a point 36***a*, 37*a* within a respective side wall panel 13, 14. Each extender cut line 36, 37 is comprised of a generally curved portion 36*b*, 37*b* and a straight portion 36*c*, 37*c*. One end of each curved portion 36*b*, 37*b* is directly connected to the curved hinge line 34, and the other end of that curved portion is directly connected to its associated straight portion 36*c*, 37*c*. It is the straight portion 36*c*, 37*c* of each extender cut line 36, 37 that terminates at point 36*a*, 37*a*, respectively, in the associated side wall panel 13, 14. In this regard, therefore, it can be said that each extender cut line 36, 37 is of a generally linear configuration which is generally tangentially connected to an extension of the curved hinge line 34 as at 36*d*, 37*d*. Note also that the point 36*a*, 37*a* at which each extender cut line 36, 37 terminates in its associated side wall panel 13, 14 is located on a phantom line 38 co-linear with the transverse edge cut line 33.

The definition of handle flap 40 is completed by an end edge breakaway cut line 41, 42 connected between each end 33*a*, 33*b*, respectively, of the free edge cut line 33 and intermediate point 36*d*, 37*d* within the top wall panel 15 on that extender cut line 36, 37 located on the same side of the longitudinal axis 32 as the end 33*a*, 33*b* of the free edge cut line to which that end edge breakaway cut line is connected. In effect, however, the end edge cut lines 41, 42 are simply extensions of the free edge breakaway cut line 33 so that it is the free edge breakaway cut line itself which is connected to the respective extender cut lines 36, 37 which constitute the extensions of the curved hinge line 34. With this handle hole outline established by the aforementioned cut and hinge lines 33, 34, 36, 37, 41, 42, note that, on each side of the center panel's longitudinal axis 32, the respective end edge cut line 41, 42 in combination with the extender cut line 36, 37 to which the respective end edge cut line is connected, and in further combination with the phantom line 38 co-linear with the transverse free edge cut line 33, all cooperate to establish a generally triangular configuration 43, 44 partially defined on the top wall panel 15 and partially defined on the associated side wall panel 13, 14 of the carton blank 9 when it is in the blank configuration as illustrated in FIGS. 2 and 2A.

The handle flap 40 so defined is provided with primary 45 and secondary 46 flaps. These primary 45 and secondary 46 flaps are separated one from the other by a fingertip hinge line 47 located within the handle flap 40 and disposed generally parallel to the free edge cut line 33. It is the fingertip hinge line 47 which separates the handle flap 40 into primary 45 and secondary 46 flaps foldable relative one to the other and relative to the curved hinge line 34, as the handle flap 40 is broken away from the top wall panel 15. Note particularly, as illustrated in FIG. 2A, that, on each side of the longitudinal axis 32 of the top wall panel 15, a phantom line 48 co-linear with the fingertip hinge line 47 in combination with an end edge cut line 41, 42, and in further combination with that extender cut line 36, 37 to which the end edge cut line 41, 42 is connected, all cooperate to establish a generally triangular configuration 49, 50, respectively, wholly defined within the top wall panel 15. In preferred form, the fingertip hinge line 47 is partially defined by cut lines 51 which enhance the foldability of the secondary flap 46 underneath and relative to the primary flap 45 as the handle flap 40 is broken away from the top wall panel. Also in preferred form, the handle flap 40 is sub-divided into two sub-flaps 40*a*, 40*b* through use of a separator breakaway cut line 52 that extends between the free edge cut line 33 and the curved hinge line 34. Note this separator breakaway cut line 52 is co-linear with the longitudinal axis 32. The separator breakaway cut line 52 enhances the ease with which the handle flap 40 may be broken away from the top wall panel 15 during use.

In use, and as illustrated in FIG. 3, the handle flap 40 has only a single hinge line 34 or fold line about which the flap folds. So in order to break the flap 40 away and bend it under the carton's top wall panel 15, the user's hand 53 is oriented as shown in that figure with the user's fingers being pointed in a direction toward the curved hinge line 34 and away from the free edge breakaway cut line 33. With the user's hand 53 so oriented, the user's first and second fingers 54, 55 bear against the secondary flap 46*a* on one side of the separator breakaway 52, and the user's third and fourth fingers 56, 57 bear on the secondary flap 46*b* on the other side of the separator breakaway so as to commence breaking away the secondary flap 46 from the top wall panel 15 and, thereby, commence folding the secondary flap under the primary flap 45 about fingertip hinge line 47. Subsequently, the user's fingers 54–57 break away the primary flaps 45*a*, 45*b* through use of the end edge breakaway cut lines 41, 42, and through use of the extender cut lines 36, 37 which interconnect the ends 34*a*, 34*b* of the curved hinge line 34 with those end edge breakaway cut lines, until all cut lines 33, 36*b*, 37*b*, 41, 42 are fully broken away from the top wall panel 15 so as to define the handle hole 31, and so as to fold the primary 45 and secondary 46 flaps underneath the top wall panel on the curved hinge line 34.

With the handle flap 40 so broken away from the top wall panel 15, and folded under the top wall panel on the curved hinge line 34, the wraparound carton 11 can be easily carried as shown simply by the user's fingers 54–57 being inserted under that top wall panel in order to lift up the carton. Now with the carton being so carried, the stress induced in those areas of the top wall panel 15, as well as in those areas of the adjacent side wall panels 13, 14, which are adjacent to the handle hole 31 is relieved if required by allowing the controlled tearing of those panels 13–15 along the remainder of the extender cut lines 36*c*, 37*c* that extend beyond the handle hole. In other words, as the carton is being carried, and if stress induced in the side wall panels 13, 14 of the carton demands it, one or both of the extender cut line sections 36*c*, 37*c* which extend beyond the handle hole 31 can break away partially or fully in order to minimize the chances of tearing the paperboard carton's top 15 and/or side wall 13, 14 panels other than in the controlled fashion permitted by the extender cut lines 36*c*, 37*c*.

Having described in detail the preferred embodiment of my invention, what I desire to claim and protect by Letters Patent:

1. A carton with carrying handle, said carton having a top wall panel with opposed side edges and a longitudinal axis, and a side wall panel connected on a fold line to each of said side edges, said handle comprising a free edge breakaway cut line located within said top wall panel and disposed substantially transverse to said longitudinal axis, the opposed ends of said free edge cut line being located on opposite sides of said longitudinal axis and interiorly of said top wall panel between those fold lines by which said top wall panel is connected to said side wall panels, said free edge cut line thereby terminating short of those fold lines at each end thereof, a generally curved hinge line located within said top wall panel opposite to and spaced from said free edge cut line, said curved hinge line being bowed toward said free edge cut line, the opposed ends of said curved hinge line being located on opposite sides of said longitudinal axis and interiorly of said top wall panel between those fold lines by which said top wall panel is connected to said side wall panels, said hinge line thereby also terminating short of those fold lines at each end thereof, an extender cut line connected to each end of said curved hinge line, each extender cut line constituting a co-linear extension of said hinge line, each extender cut line being of a length that traverses an adjacent fold line that connects said top wall panel and an adjacent side wall panel, each extender cut line terminating within a side wall panel, and each extender cut line terminating at a point located on or generally adjacent to a phantom line co-linear with said transverse free edge cut line, and an end edge breakaway cut line that connects each end of said free edge cut line with an adjacent extender cut line on one side of said longitudinal axis within said top wall panel so as to define a handle flap foldable on said curved hinge line within said top wall panel and so that each end edge cut line, that extender cut line to which said end edge cut line is connected, an the phantom line co-linear with said transverse free edge cut line, all cooperate to establish a generally triangular configuration partially defined on said top wall panel and partially defined on an associated side wall panel, thereby so as to define a handle hold that permits a user's fingers to be received therethrough so that said carbon can be carried by a user.

2. A carton as set forth in claim 1, said curved hinge line being of a generally arcuate configuration.

3. A carton as set forth in claim 2, each extender cut line having generally curved and generally straight line portions, one end of said curved portion being directly connected to said curved hinge line and the other end of said curved portion being directly connected to said straight portion.

4. A carton as set forth in claim 2, each extender cut line comprising a generally linear configuration which is tangentially extended from said curved hinge line.

5. A carton as set forth in claim 4, said curved hinge line having a single radial center point located on that side of said free edge breakaway cut line which is opposite to that side on which said curved hinge line is located.

6. A carton as set forth in claim 1, each end edge breakaway cut line being connected between an end of said free edge cut line and an intermediate point on that extender cut line located on the same side of said longitudinal axis as said end of said free edge cut line.

7. A carton as set forth in claim 1 said carton comprising a fingertip hinge line located within said handle flap and disposed generally parallel to said free edge cut line, said fingertip hinge line separating said handle flap into primary and secondary flaps foldable relative one to the other and relative to said curved hinge line, as said handle flap is broken away from said top wall panel.

8. A carton as set forth in claim 7, a phantom line co-linear with said fingertip hinge line cooperating with each end edge cut line and that extender cut line to which said end edge cut line is connected to establish a generally triangular configuration wholly defined on said top wall panel.

9. A carton as st forth in claim 8, said carton comprising a separator breakaway cut line that extends between said free edge cut line and said curved hinge line, said separator cut line permitting said handle flap to be sub-divided into two sub-flaps as said handle flap is broken away from said top wall panel.

10. A carton as set forth in claim 8, said fingertip hinge line being partially defined by a cut line.

11. A blank for a carton with carrying handle, said blank having a top wall panel with opposed side edges and a longitudinal axis, and a side wall panel connected on a fold line to each of said side edges, said handle comprising a free edge breakaway cut line located within said top wall panel and disposed substantially transverse to said longitudinal axis, the opposed ends of said free edge cut line being located on opposite sides of said longitudinal axis and interiorly of said top wall panel between those fold lines by which said top wall panel is connected to said side wall panels, said free edge cut line thereby terminating short of those fold lines at each end thereof, a generally curved hinge line located within said top wall panel opposite to and spaced from said free edge cut line, said curved hinge line being bowed toward said free edge cut line, the opposed ends of said curved hinge line being located on opposite sides of said longitudinal axis and interiorly of said top wall panel between those fold lines by which said top wall panel is connected to said side wall panels, said hinge line thereby also terminating short of those fold lines at each end thereof, an extender cut line connected to each end of said curved hinge line, each extender cut line constituting a co-linear extension of said hinge line, each extender cut line being of a length that traverses an adjacent fold line that connects said top wall panel and an adjacent side wall panel, and each extender cut line terminating within a side wall panel, and each extender cut line terminating at a point located on or generally adjacent to a phantom line co-linear with said transverse free edge cut line, an end edge breakaway cut line that connects each end of said free edge cut line with an adjacent extender cut line on one side of said longitudinal axis within said top wall panel so as to define a handle flap foldable on said curved hinge line within said top wall panel and so that each end edge cut line, that extender cut line to which said end edge cut line is connected, and that phantom line co-linear with said transverse free edge cut line, all cooperate to establish a generally triangular configuration partially defined on said top wall panel and partially defined on an associated side wall panel, thereby so as to define a handle hole that permits a user's fingers to be received therethrough so that a carton erected from said blank can be carried by a user.

12. A blank as set forth in claim 11, said curved hinge line being of a generally arcuate configuration.

13. A blank as set forth in claim 12, each extender cut line having generally curved and generally straight line portions, one end of said curved portion being directly connected to said curved hinge line and the other end of said curved portion being directly connected to said straight portion.

14. A blank as set forth in claim 12, each extender cut line comprising a generally linear configuration which is tangentially extended from said curved hinge line, and said curved hinge line having a single radial center point located on that side of said free edge breakaway cut line which is opposite to that side on which said curved hinge line is located.

15. A blank as set forth in claim 11, each end edge breakaway cut line being connected between an end of said free edge cut line and an intermediate point on that extender cut line located on the same side of said longitudinal axis as said end of said free edge cut line.

16. A blank as set forth in claim 11, said blank comprising a fingertip hinge line located within said handle flap and disposed generally parallel to said free edge cut line, said fingertip hinge line separating said handle flap into primary and secondary flaps foldable relative one to the other and relative to said curved hinge line, as said handle flap is broken away from said top wall panel, and a phantom line co-linear with said fingertip hinge line cooperating with each end edge cut line and that extender cut line to which said end edge cut line is connected to establish a generally triangular configuration wholly defined on said top wall panel.

* * * * *

UNITED STATES PATENT AND TRADEMARK OFFICE

CERTIFICATE OF CORRECTION

PATENT NO. : 5,106,014

DATED : April 21, 1992

INVENTOR(S) : Charles A. Miller

It is certified that error appears in the above-identified patent and that said Letters Patent is hereby corrected as shown below:

Column 5, line 32 delete "an the phantom" and insert -- and that phantom --

Column 5, Line 39 delete "carbon" and insert -- carton --

Signed and Sealed this

Fourteenth Day of December, 1993

Bruce Lehman

*Attest:*

BRUCE LEHMAN

*Attesting Officer*

*Commissioner of Patents and Trademarks*